United States Patent [19]

Guglielmo

[11] Patent Number: 4,536,915

[45] Date of Patent: Aug. 27, 1985

[54] MACHINE FOR TRUING ELECTRICAL COLLECTORS AND THE LIKE

[76] Inventor: Jean Guglielmo, 58 Rue Pasteur, 69300 Caluire, France

[21] Appl. No.: 476,282

[22] Filed: Mar. 17, 1983

[30] Foreign Application Priority Data

Mar. 22, 1982 [FR] France ..... 82 05261

[51] Int. Cl.[3] ..... A47L 7/04

[52] U.S. Cl. ..... 15/345; 15/312 R; 51/244

[58] Field of Search ..... 15/312 R, 345; 51/67, 51/244, 281 R, 289 R

[56] References Cited

U.S. PATENT DOCUMENTS

| | | | |
|---|---|---|---|
| 1,795,262 | 3/1931 | Myers . | |
| 1,935,805 | 11/1933 | Luft | 51/244 |
| 2,599,954 | 6/1952 | Tibbs | 51/241 |
| 2,741,078 | 4/1956 | Tenney | 51/244 |
| 2,784,537 | 3/1957 | Schinske | 51/244 |
| 2,790,281 | 4/1957 | Baugh | 51/241 |
| 3,161,900 | 12/1964 | Hornschuch et al. | 15/345 |
| 3,436,785 | 4/1969 | Kantor | 15/345 X |
| 3,678,534 | 7/1972 | Hilbig | 15/345 |
| 3,849,946 | 11/1974 | Ogura | 51/244 |
| 3,948,005 | 4/1976 | Witsett | 51/180 |
| 3,965,623 | 6/1976 | Grutza | 51/281 R |
| 4,007,562 | 2/1977 | Egashira | 51/244 |
| 4,380,842 | 4/1983 | Thomas | 15/312 R |

FOREIGN PATENT DOCUMENTS 2325464 4/1977 France .

*Primary Examiner*—Chris K. Moore
*Attorney, Agent, or Firm*—Dowell & Dowell

[57] ABSTRACT

A machine for truing the collectors or other rotating contact members of a motor, comprises a tool-holder carriage adapted to be fixed either against a brush-holder support associated with the collector or rotor, or against the face of the lower access opening of the casing of the motor, the engagement being provided by a connector coupled to the frame. Truing is effected by an abrasive stone driven in reciprocating motion along the collector. A double blowing and suction nozzle eliminates the dust. A brush and a sensor may be mounted on the carriage to eliminate the adherent dust and monitor eccentricity. The carriage is borne by a pivotable fork, by a parallelogram and by a double carriage rolling in a pit beneath the railway track.

12 Claims, 5 Drawing Figures

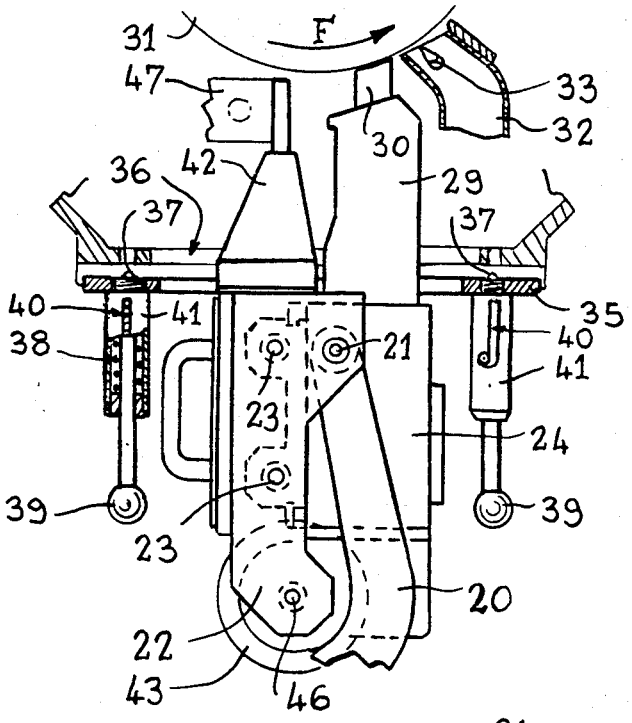
Fig. 3
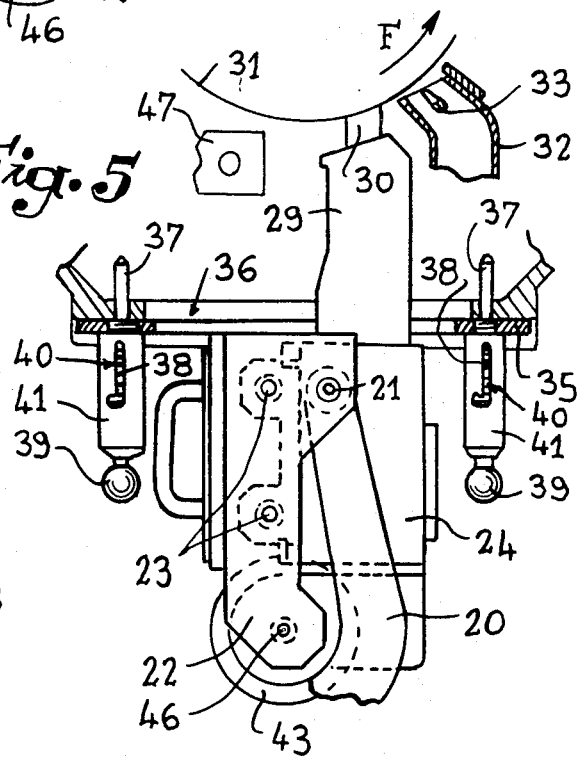
Fig. 5
Fig. 4
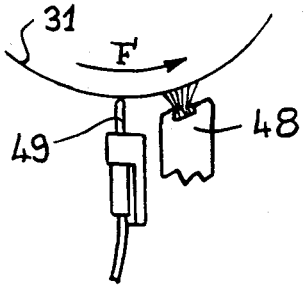

MACHINE FOR TRUING ELECTRICAL COLLECTORS AND THE LIKE

The present invention relates to a machine for truing electrical collectors and the like.

It is known that collectors of D.C. motors must be trued from time to time in order to function correctly. The same applies to the rotary rings for connection between a rotor and the corresponding stator circuits. This truing work may be effected on the lathe after dismounting of the armature or rotor, but it may also be effected by grinding, without prior dismounting thereof. An abrasive stone is often employed, fixed to an appropriate carriage which is advanced progressively in the direction of the axis until all the defects in eccentricity as well as any superficial irregularities are eliminated. Of course, the carriage must be supported by a device rigidly fixed to the electric motor in question and this sometimes raises very difficult problems.

In the particular case of motors of electric railway vehicles, the procedure generally consists in opening the inspection access door of the motor in question, removing the single or multiple brush-holder facing it and mounting on the support thereof the chassis which bears the carriage to which the abrasive stone is fixed, the whole being located, at least to a large extent, inside the engine, in a reduced space which makes it necessary to use small-dimensioned mechanisms which are difficult to actuate by the operator and which must be entirely controlled by hand. This modus operandi, which must be repeated for each of the motors of the vehicle in question, is in practice very long and very delicate to carry out.

It is an object of the invention to overcome this drawback and to provide a machine thanks to which all the necessary operations may be considerably simplified.

According to the invention, the machine is dimensioned and arranged to be fixed not only to a part inside the motor, such as a brush-holder support, but also, if desired, to the outer part of this motor.

It will be understood that one is no longer limited by the volume of the inner space available inside the motor. The machine may therefore be provided with all desirable mechanisms for facilitating manoeuvring thereof and for rendering it automatic, at least in part, if desired.

In one embodiment, the machine according to the invention, more particularly intended to be placed in a conventional pit for maintenance and repair of railway vehicles, comprises a first carriage adapted to roll along the bottom of the pit lengthwise with respect to the track, a second carriage mounted on the first so as to move transversely thereto, a turret borne by the second carriage so as to rotate thereon about a vertical axis, an arm, preferably in the form of an articulated parallelogram, fixed to this base, a first support borne by this parallelogram so as to rotate with respect thereto about a substantially vertical axis, a second support articulated to the first about a substantially horizontal axis, means for fixing the second support to a non-rotating element of the motor or housing containing the member to be trued, a tool-holder carriage borne by the second support so as to move thereon in a substantially horizontal direction, means for driving this tool-holder carriage in a reciprocating motion parallel to the axis of the motor, and means for advancing towards the member to be rectified the tool borne by the tool-holder carriage mentioned above.

It will be understood that such a machine enables the operators to bring the tool-holder carriage easily to the exact position desired, to fix it there, and then carry out the truing operation.

The invention will be more readily understood on reading the following description with reference to the accompanying drawings, in which:

FIG. 3 is a view in detail of all the parts borne by the articulated parallelogram, it being assumed that the connection between the machine and the non-rotating assembly of the traction motor in question is made via the brush-holder support.

FIG. 4 schematically shows how the final phase of cleaning and polishing the trued collector is carried out.

FIG. 5 is a view similar to that of FIG. 3, but assuming that the connection of the machine to the motor is made at the opening of the inspection door.

Figure 1:
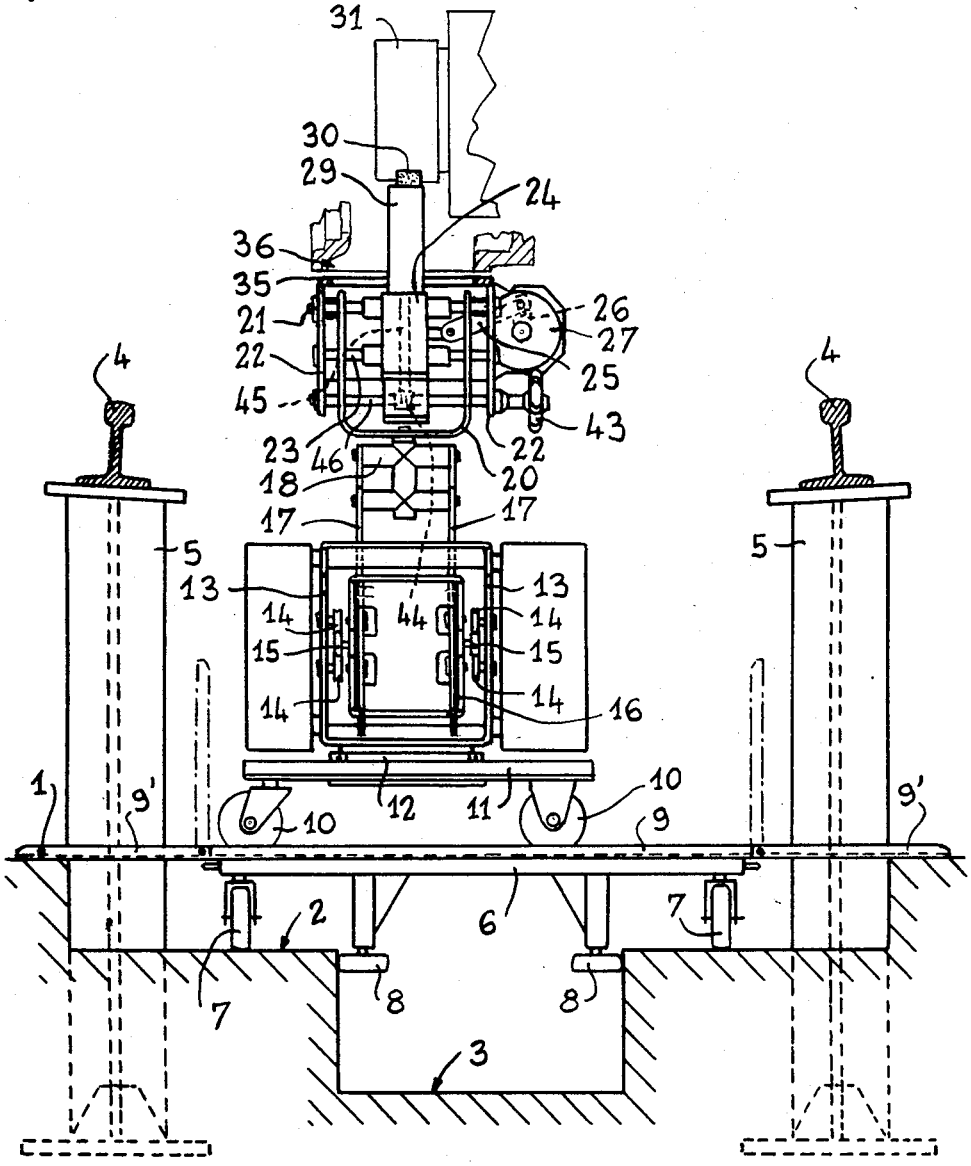
FIG. 1 is an end view of a machine according to the invention disposed at the bottom of a railway vehicle inspection and maintenance pit, the suction nozzle system being assumed to have been removed and the downward extensions of the arms of the articulated parallelogram being cut for clarity of the drawing.
Figure 2:
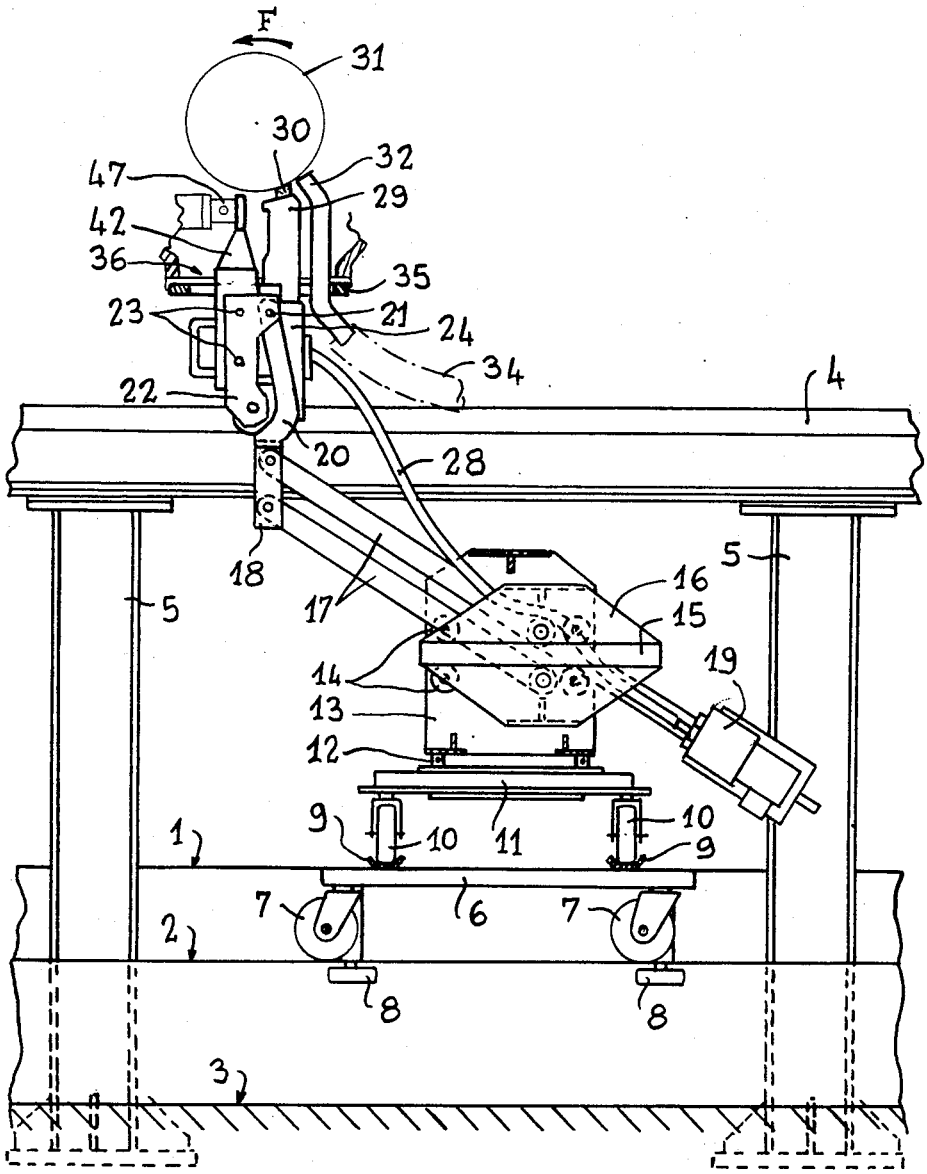
FIG. 2 is a side view corresponding to FIG. 1.

Referring now to the drawings, FIGS. 1 and 2 denote ground level by reference 1. A first pit is dug out to a lower level 2, and then a second, narrower pit along the axis of the preceding one, to a level 3. The rails 4 of the track are borne by pillars 5 at a level higher than ground level 1.

Along the bottom of the first pit, namely at level 2, a carriage 6, or primary carriage, rolls, supported by casters 7 and guided in the longitudinal direction with respect to the track by other casters 8 horizontally disposed to bear against the vertical walls bordering the central pit (level 3). The carriage 6 in turn supports transverse rails 9 of U-section, on which the casters 10 of a secondary carriage 11 may move. On the latter is rotatably mounted a vertical turret 12 equipped with two cheeks 13 bearing casters 14 between which may move rails 15 fixed to a horizontal, cage-shaped carriage 16. On the inner faces of the carriage 16 are articulated four arms 17 whose ends are coupled to an element 18 so as to constitute two parallel deformable parallelograms. In FIG. 1, these parallelograms are disposed in two vertical planes symmetrical with respect to the mean vertical plane of the carriage 16. In the section of FIG. 2, only one of them is visible. It will be noted that the two upper arms 17 extend opposite element 18 so as to bear a gear-down motor 19 adapted to ensure control of the displacement of the stone, as will be seen hereinafter, and which also acts as a counterweight at least approximately balancing the load supported by the arms 17.

FIG. 1 clearly shows the shape of the element 18, namely a vertical central part provided with two cross pieces at the ends of which the arms 17 are articulated. The central part is hollow and serves as hub for a vertical shaft which bears at its end a fork 20 oriented upwardly so as to constitute a first support. At the upper ends of the fork is provided a horizontal shaft 21 (FIG. 3) which supports a frame or second support composed of two lateral chassis cheeks 22 assembled by cross pieces 23 (FIG. 1).

The cross pieces 23 form slide guides for a tool-holder carriage 24 (FIG. 1) which may thus move horizontally thereon in a reciprocating motion under the effect of a connecting rod 25 coupled to a crank pin 26 borne in eccentric manner by a plate 27 mounted to rotate on a lateral lug of the chassis 22-23. The axis of the plate 27 is connected to the motor 19 by a flexible transmission 28 (FIG. 2).

The carriage 24 is extended upwardly by a sliding part 29 adapted to bear the abrasive stone 30 (FIG. 3) intended to true the collector 31 in question. It will be noted that, normally, this stone is located slightly downstream of the lowest generatrix of this collector assumed to rotate in the direction of arrow F in FIGS. 3 and 4. Immediately downstream of the stone 30 there is provided a suction nozzle 32 of relatively large section, which opens in the immediate vicinity of the collector 31, and substantially in the axis of this nozzle is disposed a blowing nozzle 33 of much smaller section supplied with pressurized air from a pipe (not detailed) which may be disposed inside the flexible hose 34 (FIG. 2) to which nozzle 32 is connected. The assembly composed of nozzle 32 and nozzle 33 is fixed to the carriage 24 so as to move in reciprocating motion therewith.

It should be noted that, to render the drawing clearer, the suction nozzle 32 and the nozzle 33 have been assumed to have been removed in FIG. 1.

The chassis 22 is fixed to a frame 35 adapted to be disposed below the access opening 36 provided in conventional manner in the bottom of the casing of the motor to which the collector 31 corresponds. In this frame are mounted vertical centering studs 37 urged upwardly by individual springs 38, but which may be lowered thereagainst with the aid of knobs 39, then locked into retracted position by bayonet-type notches 40 made in guide sleeves 41. A connecting piece 42 whose role will be set forth hereinafter may also be fixed on the chassis 22.

To control the vertical advance of the sliding part 29 of the carriage 24, the conventional arrangement has been provided, consisting in a lateral control handle 43 (FIG. 1) which drives an endless screw 44, which in turn drives by a helical gearing system a vertical shaft 45 comprising a threaded part engaged inside a corresponding threaded bore in said part 29. This arrangement being well known in the art, the details thereof have not been shown in the drawings. However, it should be particularly noted that, to avoid the handle 43 being also driven in the horizontal reciprocating motion in which the carriage 24 is driven, the endless screw 44 has been mounted with sliding key on its shaft 46, care being taken to provide means, such as lateral retaining bearings, for maintaining it centered with respect to the vertical shaft 45. In addition, with a view to avoiding any false manoeuvre, a friction device intervening in the advance direction to limit the pressure of the stone on the collector, has been incorporated in the handle 43.

The machine which has just been described is used as follows:

The part of the vehicle where the motor in question is located is firstly raised until the wheels which are driven by said motor no longer touch the rails 4. The door is removed to reveal the access opening 36. The, or each, lower brush-holder is dismounted through said opening, and then the two carriages 6 and 11 are displaced and the turret 12 is rotated so that the frame 35 is located substantially below the said access opening 36. The studs 37, FIG. 3, being in retracted position. The arms 27 are then progressively raised, the longitudinal position of the lower carriage 6 is more or less roughly adjusted and the longitudinal adjustment is completed by displacing the carriage 16 until the connecting piece 42 is guided against the support 47 (FIGS. 2 and 3) of the dismantled brush holder and is fixed thereto by means of appropriate screws or bolts. It is important to note in this respect that the articulation of the fork 20 on the chassis cheeks 22 makes it possible to compensate any possible obliquities in the longitudinal sense resulting for example from the lifting of a bogie. Those obliquities corresponding to the transverse sense are much less considerable and are in practice absorbed by the inevitable clearances and by the elasticity of the pieces.

The motor to which the collector 31 to be trued corresponds is then rotated in the direction of arrow F, which does not raise any difficulty since the wheels which it drives are raised. The motor 19 is started up on the machine, which provides reciprocating motion of the carriage 24 and consequently the stone 30, by the flexible transmission 28. It then suffices to cause the stone to approach progressively, via handle 43, so that it bears against the collector and effects truing thereof over the whole of its length.

During this operation, the detached metal dust passes in front of the suction tube 32 which evacuates it, the nozzle 33 detaching that dust which tends to remain adherent to the collector.

Of course, the foregoing assumes that the stroke of the carriage 24 corresponds to the axial length of the collector, but, if this is not the case, it is easy to adjust this stroke, for example by using crank pin devices having a radius of adjustable length, well known in the art.

It will further be noted that, in FIG. 1, it has been assumed that the arms 17 were located exactly in a longitudinal plane. However, it may be otherwise, particularly when the collector is strongly offset to one side with respect to the axis of the track. In such a case, the turret 12 is rotated through the desired angle and the obliquity is compensated thanks to the possibility of rotation of the fork 20 in the element 18. It should be noted in this respect that, when one is located between two successive pillars 5, the carriage 11 may always be strongly offset laterally by using to this end lateral rails 9' (FIG. 1) which project on each side, but which may be lifted to the position indicated in chain-dotted lines when passing level with a pillar 5.

Once the truing operation is terminated, the stone 30 is dismounted and replaced by a brush 48 (FIG. 4), for example made of Nylon. By continuing to rotate the engine of the vehicle and that of the machine, the dust is evacuated and the collector is polished.

It will be noted that FIG. 4 shows a point 49 coming into contact with the collector 31. This is an eccentricity sensor which is fixed to the sliding part 29 of the tool-holder carriage 24 so as to verify that the rectification truing work has been correctly carried out and that the collector is perfectly cylindrical.

It then suffices to dismount the attachment to the brush holder 45, to lower the arms 27, to withdraw the machine, to reassemble the brush-holder, to close the inspection access door and finally to lower the vehicle on its rails.

In certain cases, the locomotives or other railway vehicles of which it is desired to true the collector, comprise an inspection door machined so as to be located in a position very exactly defined with respect to the collector of the engine in question. In such a case, it may be advantageous to proceed somewhat differently from what has been set forth hereinabove. The connecting piece 42 being removed, before raising the arms, care is taken to release the studs 37 so that they clearly project above the frame 35 (FIG. 5). They are then introduced into the perforations 47 provided in the edge of the opening 36 of the inspection door. The frame 35 may thus be centred very exactly, then fixed to the opening 36 by means of appropriate bolts. It is possible in particular to provide clearly fewer studs 37 than perforations 47 and to use those perforations not traversed by such studs for receiving the fixing bolts. Subsequent operation is carried out in the manner set forth hereinabove.

It must be understood that the foregoing description has been given only by way of example and that it in no way limits the domain of the invention whose scope would not be exceeded by replacing the details of execution described by any other equivalents. In particular, although the machine according to the invention has been described in its application to railway stock, it may be used in all cases where similar problems are raised. For example, it may perfectly well ensure truing of the rings of rotors of alternators in power stations whenever a sufficient space has been provided below the rings in question.

What is claimed is:

1. A machine for truing electrical connection members of a rotor rotatably mounted with respect to non-rotating casing parts of electrical machinery such as a traction motor, the machine having a tool holder system attachable to said non-rotating parts and comprising:

a first carriage located between the machinery and supported to roll in a longitudinal direction;

a second carriage supported on the first carriage and operative to roll in a transverse direction;

a turret borne by the second carriage and operative to rotate about a vertical axis;

arm means articulated at one end to the turret about a substantially horizontal axis;

a first support articulated about a horizontal axis to the arm means at the other end thereof, and rotatable about a vertical axis;

a second support articulated to the first support about a substantially horizontal axis;

means for fixing the second support to a non-rotating part of the machinery;

a tool-holder carriage borne by the second support to move with respect thereto in a substantially horizontal direction;

means for driving the tool-holder carriage horizontally with a reciprocation motion;

a grinding tool borne by said tool-holder carriage;

and means for advancing said tool-holder carriage toward the rotor members to be trued.

2. The machine of claim 1, wherein the machinery is the traction motor of a railway vehicle supported on a track, and the first carriage is supported in a pit and operative to roll longitudinally of the track.

3. The machine of claim 1, wherein the first carriage supports rail means transversely disposed with respect to the track, and the second carriage is supported on the rail means for transverse movement therealong, the rail means being retractable and extensible transversely of the first carriage.

4. The machine of claim 1, wherein said arm means comprises multiple arms pivotally attached to said turret at one end and to said first support at the other so that the arms form a parallelogram whose other end is moveable in a vertical plane.

5. The machine of claim 1, wherein said means for driving the tool-holder carriage with a reciprocating motion comprises an auxiliary motor supported by an elongated transmission extending from the first support along the arm means to the auxiliary motor located beyond the turret and forming a counterweight for the arm means.

6. The machine of claim 1, wherein said non-rotating parts include a brush holder in the casing, and said second support has means for fixing it to said brush holder.

7. The machine of claim 1, wherein said casing includes an access door opposite said rotor connection members, and said second support has means for fixing it to said casing at the access door.

8. The machine of claim 7, wherein the casing has perforations adjacent to the access door, and said fixing means comprise retractable stud means extendable from the second support into said perforations to achieve exact centering of the second support.

9. The machine of claim 1, wherein the tool holder further supports an eccentricity sensor.

10. The machine of claim 1, wherein the tool holder further supports a brush positioned to sweep the dust from the rotor connection members during grinding thereof.

11. The machine of claim 1, wherein the machine further includes suction means adjacent to the grinding tool for collecting grinding dust, and a blowing nozzle at said suction means and operative to direct an air jet against the member being ground.

12. The machine of claim 11, wherein said blowing nozzle is disposed with the suction means, substantially coaxially therewith, and directed to blow outwardly thereof toward the connection members.

* * * * *